United States Patent [19]

Gogniat

[11] Patent Number: 5,065,375

[45] Date of Patent: Nov. 12, 1991

[54] WATCH CASE INCLUDING TWO ABUTING SHELLS

[75] Inventor: Paul Gogniat, Bienne, Switzerland

[73] Assignee: Montres Rado S.A., Lengnau, Switzerland

[21] Appl. No.: 655,801

[22] Filed: Feb. 15, 1991

[30] Foreign Application Priority Data

Feb. 16, 1990 [CH] Switzerland ..... 00505/90

[51] Int. Cl.[5] ..... G04C 37/00

[52] U.S. Cl. ..... 368/281

[58] Field of Search ..... 368/280-296, 368/309

[56] References Cited

U.S. PATENT DOCUMENTS

| | | | |
|---|---|---|---|
| 2,252,647 | 8/1941 | Schmitz | 368/282 |
| 2,644,294 | 7/1953 | Ditisheim | 368/282 |
| 3,545,198 | 12/1978 | Loftus | 368/282 |
| 4,637,734 | 1/1987 | Gogniat | 368/282 |
| 4,727,525 | 2/1988 | Gogniat et al. | 368/282 |

FOREIGN PATENT DOCUMENTS

| | | |
|---|---|---|
| 609790 | 8/1926 | France . |
| 53-22370 | 3/1978 | Japan . |
| 49936 | 1/1910 | Switzerland . |
| 49937 | 1/1910 | Switzerland . |
| 110141 | 6/1925 | Switzerland . |
| 1175500 | 3/1959 | Switzerland . |
| 1359773 | 7/1976 | Switzerland . |
| 671493 | 9/1989 | Switzerland . |

*Primary Examiner*—Bernard Roskoski

*Attorney, Agent, or Firm*—Griffin Branigan & Butler

[57] ABSTRACT

This watch case is formed by the assembly of an upper shell (1) and of a lower shell (2) onto a caseband entirely confined within said shells, the edges (11, 12) which they exhibit being visible and substantially abuting, at least over a portion of their periphery. The shells are preferably spherical caps formed from a transparent scratch resistant material.

13 Claims, 3 Drawing Sheets

WATCH CASE INCLUDING TWO ABUTING SHELLS

This invention concerns a watch case formed by the assembly of an upper shell, at least a part of which is transparent in order to render visible the time display elements, a lower shell and a caseband arranged between the shells proximate the periphery thereof, said shells and said caseband defining an interior space in which a movement is accommodated.

BACKGROUND OF THE INVENTION

There have already been described timepieces in which the movement is mounted in a case comprising two shells, at least one of which is of transparent material, such shells being applied against one another. In particular, the timepiece described in patent CH 110 141 is of this type. In this patent however, the shells are assembled by means of an extensible metallic circle placed on the joint between the shells and gripping the latter in such a manner that such joint is no longer apparent once the circle is put into place Such circle accentuates the outer contour of the watch and takes away therefrom the lightness of appearance which it could have if such circle were absent or at least invisible.

A solution permitting to confer to a wristwatch case the appearance of being substantially thinner than its real thickness, in particular to the wearer, while offering more wear resistance and rendering it less vulnerable vis-á-vis outer stresses, has already been set out in patent EP-B-0 168 010 (U.S. Pat. No. 4,637,734). This solution consists in employing a crystal having the form of a substantially spherical cap, at least a part of the periphery of which is located at a level below that of the dial. In this patent, however, the back cover of the watch is flat, secured as it is onto a caseband which is visible and which includes bracelet attaching means, these also visible.

The purpose of this invention is to give to the case the appearance of being thin, this impression being however still more emphasized than in the watch described in the patent EP-B-0 168 010. On the other hand, the applied one against the other, gives to the watch case a new and original design aspect.

SUMMARY OF THE INVENTION

In a preferred embodiment of the invention, it is arranged to hide the points where the bracelet is attached on the interior of the case in a manner such that the bracelet emerges from the case without having recourse to lugs or other visible hinges. Other advantages of this invention will appear from reading the description which is to follow, such invention being mainly characterized by the fact that the caseband exhibits upper and lower faces respectively arranged to match the form of the respective lower and upper faces exhibited by the upper and lower shells, so as to serve as support surfaces therefor and that said caseband is entirely confined within said shells, the edges which they exhibit being visible and substantially abuting over at least a portion of their periphery.

The invention is now to be described with the help of the accompanying drawing which shows several embodiments given by way of example.

DESCRIPTION OF THE PREFERRED EMBODIMENTS

Figure 1:
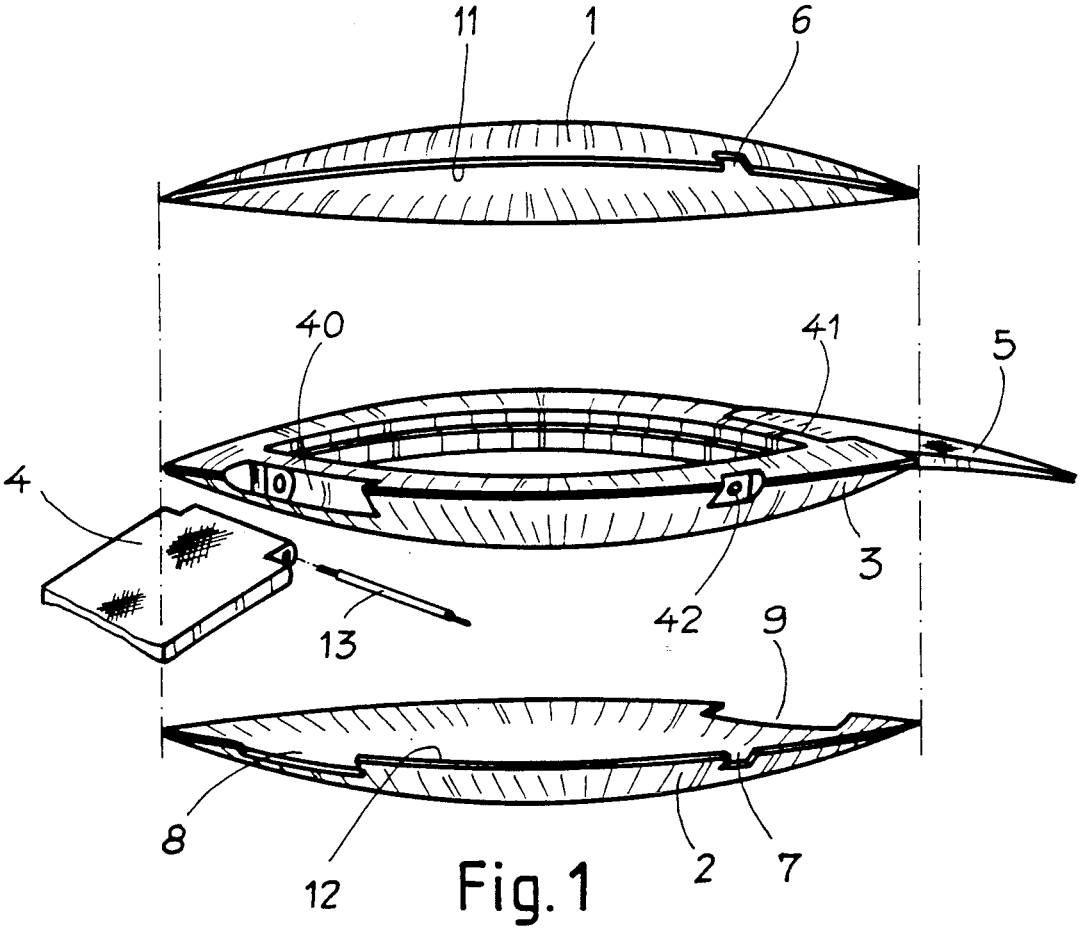
FIG. 1 is a perspective view of a watch case according to the invention and according to a first embodiment, in which have been shown only the essential constitutive parts.

FIG. 1 shows in perspective the essential parts of the watch case according to the invention. Such case includes an upper shell 1, a part at least of which is transparent in order to render visible the time displaying elements, for example a dial 20 and hands 18, such as shown on FIG. 3. The case further includes a lower shell 2 and a caseband 3 arranged proximate the periphery of the shells. As may be seen on FIG. 1, shells 1 and 2 and the caseband 3 define an interior space in which a movement is accommodated such as referenced 17 on FIG. 3.

Figure 4:
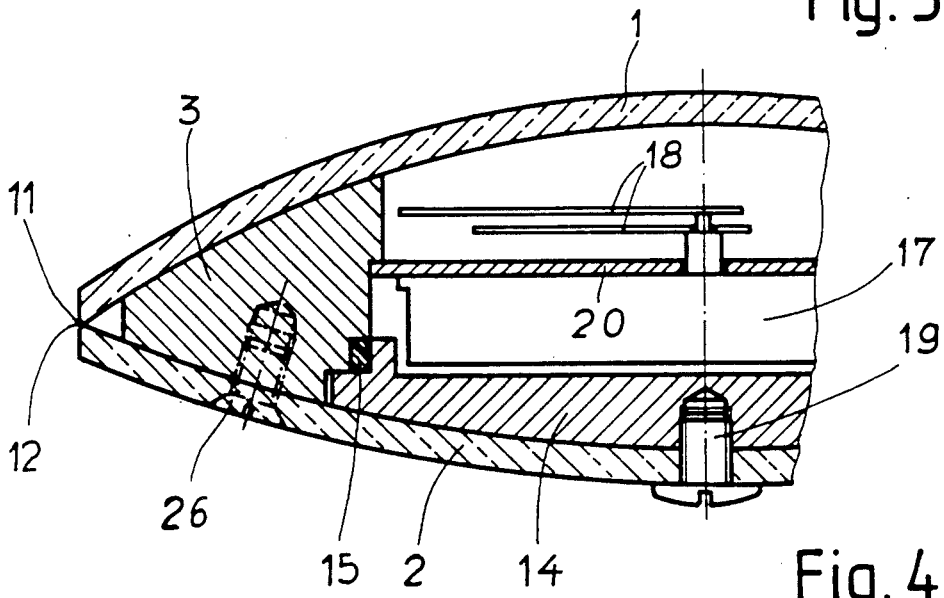
FIG. 4 is a cross-section at 9 o'clock through the case of FIG. 2.

As may be particularly well seen on FIG. 4 which is a cross-section at 9 o'clock through the assembled case, caseband 3 exhibits upper and lower faces arranged to match respectively the form of the lower and upper faces which are respectively presented by upper shell 1 and lower shell 2 in order to serve as support surfaces therefor FIG. 4 further shows that caseband 3 is entirely confined to the interior of shells 1 and 2 to the extent that in no manner does it project from the case. If one now refers to FIG. 2 which is an elevational view of the assembled case, it is seen that caseband 3 does not appear anywhere and that the edges 11 and 12 of shells 1 and 2 are visible and substantially abuting one another at least over a portion of their periphery, i.e. at the places which do not include either bracelet strands or crown.

There has thus been described the principal characteristic around which this invention turns, which has as a result a case composed of two shells having abuting edges, this conferring on the case a very special design marked by the absence of visible caseband or circle. There results therefrom a surprising effect, this giving the timepiece a simple stripped-down aspect which further accentuates the impression of thinness as suggested hereinabove.

It is self-evident that the proposed watch will have furthermore to satisfy the standard rules governing dust and water tightness. In the same manner, there will be sought to render the bracelet strand attachments as little visible as possible whilst assuring fastening of such strands which is simple and safe by easy assembly and disassembly from the lower shell To this end there will now be discussed several possible embodiments taking note that here the examples concerned are non-limiting.

FIGS. 1 to 5 show a first embodiment of the invention in which, as moreover for the other embodiments described subsequently, the caseband 3 includes securing means for the bracelet strands. In the special case of FIGS. 1 to 5, such securing means include two housings 40 and 41 provided in the caseband 3 and a lug arranged in each of these housings, only the lug 13 being shown on the figures. Around such lug is articulated strand 4 of the bracelet as may readily be seen on FIGS. 1 and 3. To allow the strand 4 to come out, the same figures show that the lower shell is provided with an opening or notch 8. In the same manner strand 5, arranged opposite strand 4, emerges from the case by the opening 9 shown on FIG. 1. This manner of execution causes the complete disappearance of the bracelet strand attachments on the interior of the two shells in a manner such that the periphery of the upper shell 1 is continuous without the interruption, which would be due to fastening lugs for instance. This effect is visible on the right hand part of FIG. 5.

Figure 2:
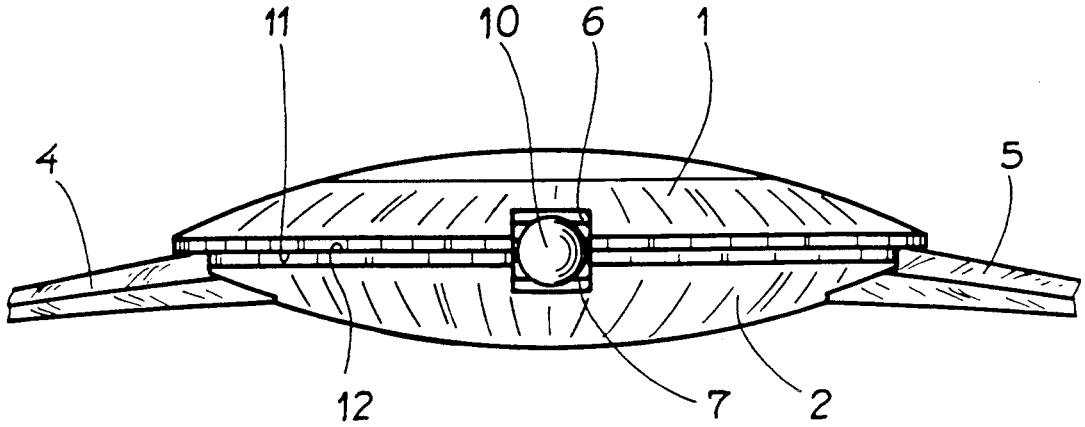
FIG. 2 is an elevational view of the case shown in FIG. 1, such case being closed.
Figure 3:
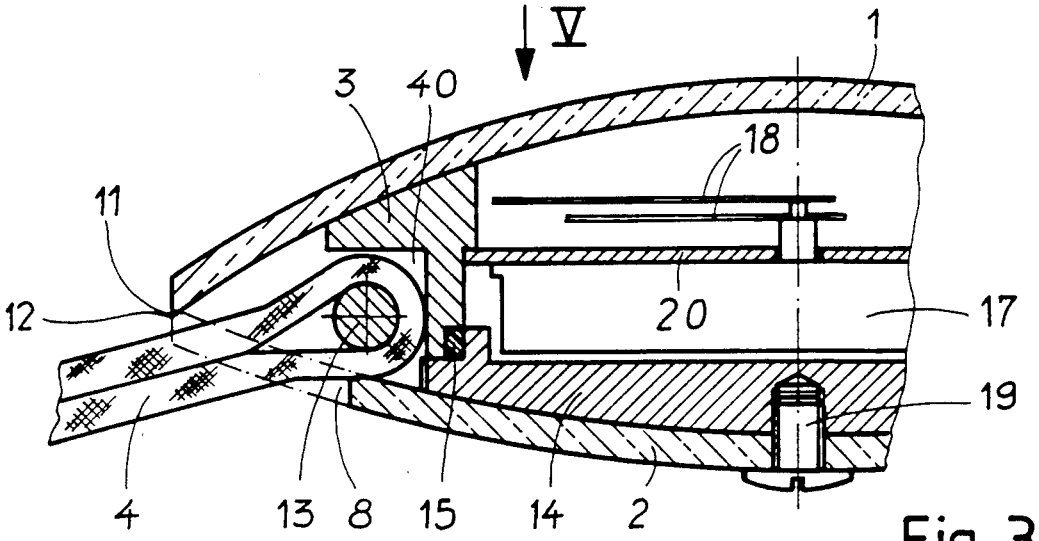
FIG. 3 is a cross-section at 6 o'clock through the case of FIG. 2.
Figure 5:
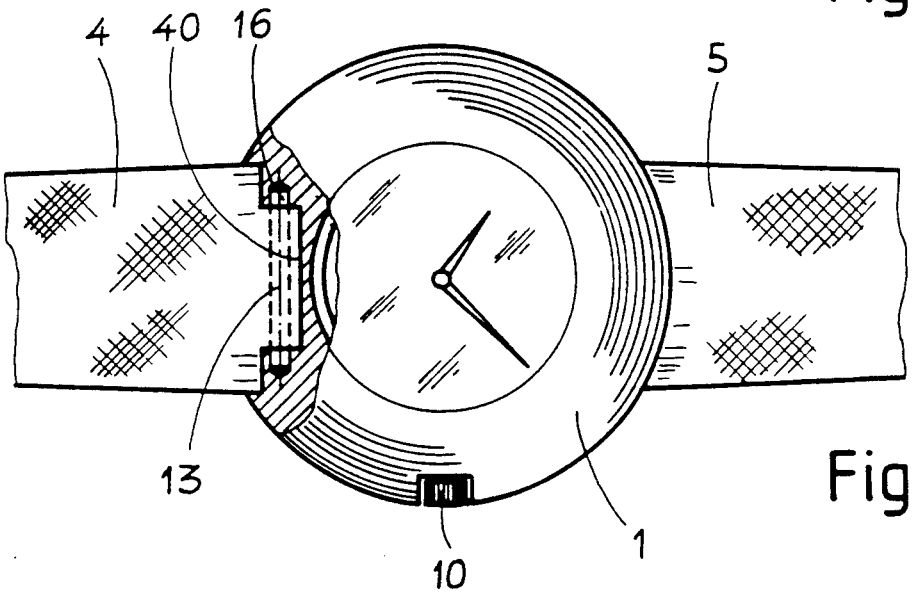
FIG. 5 is a plan view, partially broken away, of the case according to the arrow V in FIG. 3.

As is seen on FIGS. 3 and 4, the case contains a movement 17 surmounted by a dial 20 and hands 18, the movement being secured to the caseband by conventional means (not shown). Such movement includes at least one time setting stem terminated by a crown 10 (FIGS. 2 and 5). The crown is housed half within a notch 6 provided in the upper shell 1 and half within a notch 7 provided in the lower shell 2 as is seen on FIGS. 1 and 2. The control stem emerges through a hole 42 provided in caseband 3.

FIGS. 3 and 4 further show that in addition to the lower shell 2 the case includes a back cover 14 fixed to caseband 3. A seal 15 is interposed between the back cover and the caseband FIG. 4 shows that the lower face of the back cover 14 and the lower face of the caseband 3 exhibit a perceptible gap in a manner such that the lower shell 2 may be fixed either to the back cover by means of a single central screw 19 or to the caseband by means of a plurality of screws 26 shown in dotted outline on FIG. 4. In this version including a back cover, and in order to have access to the movement and eventually to the battery which energizes it, initially the lower shell 2 is removed, then the back cover 14. One may next take out the movement from below the case. As to the upper shell 1, it is simply glued onto the upper face of the caseband, the gluing by itself assuring the required sealing.

Figure 6:
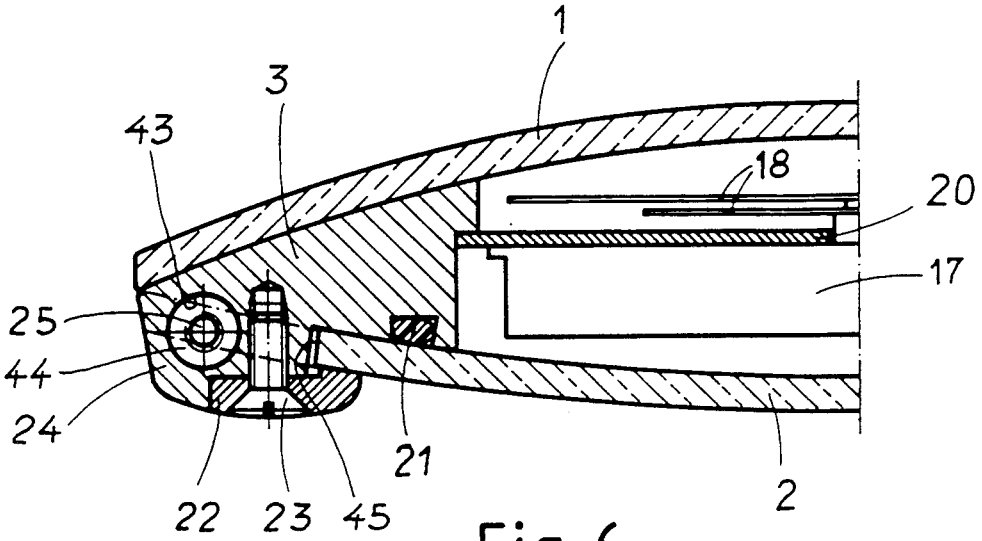
FIG. 6 is a cross-section at 6 o'clock through the case of this invention according to a second embodiment thereof.

A second embodiment is shown on FIG. 6 which is a cross-section at 6 o'clock through the case of the invention. Here the bracelet attachment means consist of a boss 24 adjoining the caseband 3 or integrally formed therewith as shown by the figure. Such boss extends under the upper shell 1 and is provided with a bore 43 which receives a lug 44. The ends of the lug emerge from the bore and each includes a threaded blind hole 25 in order to receive a screw (not shown). The bracelet, which is not shown on FIG. 6, surrounds the ends of the lug 44 around which it may pivot It is self-evident that also in this embodiment the lower shell 2 is provided with openings 45 in which the boss 24 is accommodated as well as lug 44. In this embodiment FIG. 6 shows that the upper shell 1 is glued onto the caseband 3 The lower shell 2 could, as in the example which has been explained with respect to FIG. 4, be secured by means of screws fastened into the caseband or onto a supplemental back cover. Here there has been shown a variant of the fastening which employs a foot 22 which presses the lower shell 2 onto the caseband by means of a screw 23. In this case, the figure shows that the case is not provided with a back cover as regularly understood and that sealing is assured thanks to a seal 21 interposed between the lower shell 2 and the caseband 3 This arrangement renders the disassembly of the case still more simple, such simplicity being however at the cost of a construction which is perhaps more cumbersome with bracelet attachments more visible.

Figure 7:
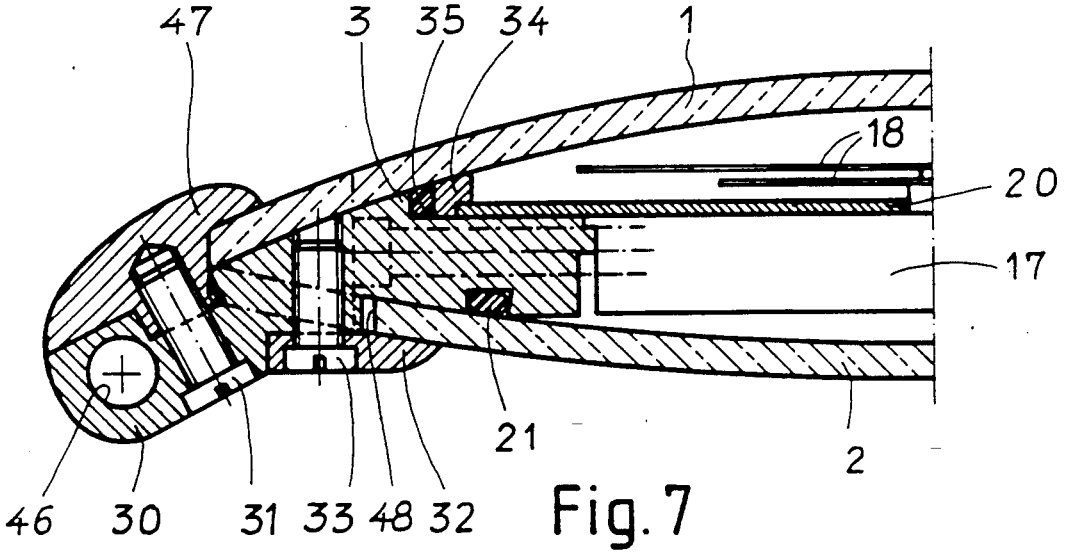
FIG. 7 is a cross-section at 6 o'clock through the case of the invention in accordance with a third embodiment thereof.

A third embodiment is shown on FIG. 7 which is a cross-section at 6 o'clock through the case of the invention. Here the bracelet attachment means consist in a projection 30 emerging under the lower shell 2 and extending outside the periphery. Such projections are integrally formed with the caseband, but could be separately attached thereto. Projection 30 is provided with a bore 46 intended to receive a lug (not shown) around which a bracelet strand may pivot. In the same manner as in the preceding embodiment, shell 2 is provided with openings 48 in order to allow the passage of the projection 30. Such shell 2 is secured to the caseband by means of feet 32 pressed on by screws 33 in the same manner as that which has been described for FIG. 6. Such third embodiment brings out a new manner of fastening the upper shell 1 to the caseband 3. To this effect a foot 47 is secured to projection 30 by means of a screw 31. Such foot presses the shell onto the caseband, a seal 35 being interposed between the shell and the caseband. In this construction the movement is cased up from above and dial 30 is held in place by a flange 34. In order to proceed with movement repairs, feet 47 will be removed while in order to change the battery feet 32 will be removed. FIG. 7 shows that this embodiment enables reduction to the maximum of the thickness of the watch since the bracelet is attached thereto outside the periphery thereof. This advantage is however obtained at the cost of visible bulges located at 6 o'clock and at 12 o'clock.

Some remarks remain to be made as to the shells themselves. On the figures, the upper and lower shells are spherical caps. The radii of curvature may be equal or unequal according to the appearance which one wishes to give to the watch.

The invention however is not limited to spherical caps, certainly more easily formed than most other shells provided that these shells exhibit abuting edges at least over a portion of their periphery.

All the shells shown on the figures are formed preferably of mineral material, for instance sapphire. There have already been mentioned in patent document EP-B-0 168 010 cited hereinabove, the advantages brought by such a material In the cited document, only the upper portion of the case, i.e. the crystal, is formed of sapphire. Here the back cover or lower shell may be likewise of sapphire which increases the interest of this invention. Thus, when given that the crystal and the back cover are preferably of a hard material, practically the entire watchcase is formed of an unscratchable material. In addition, thanks to the spherical cap form, the crystal and the back cover enable better absorption of shocks which they may undergo through transmission thereof to their seat situated on the caseband onto which they are secured (giving rise to a vault effect). Thus, in addition to the new design effect, the case of the invention offers excellent protection in respect of shocks and pressures to which a wristwatch is exposed While extra-flat wristwatches have generally been deluxe watches of a relatively fragile nature, the proposed solution enables allying the robust character to great elegance. It is thus that such a watch, well resisting pressure and exterior attacks, may be worn without fear of deterioration in all circumstances of modern life and even in severe conditions which one may encounter in submarine diving, although it is not particularly conceived to this effect.

It is however clear that the lower shell could be formed of a material other than sapphire, steel for instance. The interest of a transparent back cover resides however in the fact that it enables one to see the watch mechanism and if this is of the automatic winding type, the oscillating mass.

What I claim is:

1. A watch case for a watch having a caseband, a movement and time display elements, said watch case comprising upper shell, at least a portion of which is transparent so that the time display elements are visible therethrough, and, a lower shell, said caseband being arranged between said shells proximate the periphery thereof, said shells and said caseband defining an interior space in which said movement is located, said shells each having an upper and a lower face and a substantially constant thickness over their entire extent, said caseband having upper and lower surfaces matching the form of the respective lower and upper faces of said upper and lower shells, respectively, so as to serve as support surfaces onto which said shells are fixed, case caseband being entirely confined within said shells, and said shells having edges which substantially abut each other over at least a portion of their periphery, said edges being visible from the exterior of the watch case.

2. A watch case as set forth in claim 1 wherein at least a portion of said lower shell is transparent.

3. A watch case as set forth in claim 1 wherein said upper and lower shells are spherical caps.

4. A watch case as set forth in claim 1 wherein said caseband includes means for securing strands of a bracelet.

5. A watch case as set forth in claim 4 wherein said securing means include two housing formed in said caseband and a lug around which a strand may pivot arranged in each of the housings, said lower shell being providing with openings from which said strands emerge.

6. A watch case as set forth in claim 4 wherein said securing means include two bosses adjoining said caseband and arranged beneath said upper shell and a bore formed in each of said bosses so as to accommodate a lug around which a strand may pivot, said lower shell being provided with openings in each of which a boss and lug are placed.

7. A watch case as set forth in claim 6 and further including a foot located under the caseband and emerging from each opening, each foot serving as securing means for securing the lower shell onto the caseband, and seal interposed between said lower shell and said caseband.–

8. A watch case as set forth inlaid 4 wherein said securing means includes two projections emerging under said upper shell and extending outwards from the periphery thereof, and a bore formed in each of said projections to accommodate a lug around which a strand may pivot, said lower shell having openings for the passage of said projections.

9. A watch case as set forth in claim 8 wherein a foot is fastened onto each of said projections to serve as means for securing said upper shell onto said caseband, and a seal interposed between said uppers shell and said caseband.

10. A watch case as set forth in claim 1 wherein said upper shell is glued to said upper surface of said caseband.

11. A watch case as set forth in claim 1 and further including a back cover fixed to said caseband, a seal interposed between said back cover and said caseband, the lower face of said back cover showing a perceptible gap with the lower face of the caseband, the lower shell being secured to the back cover by means of a central screw traversing the lower shell.

12. A watch case as set forth in claim 1 wherein said upper and lower shells are formed from mineral material.

13. A watch case as set forth in claim 1 and further including a back cover fixed to case caseband, a seal interposed between said back cover and said caseband, the lower face of said back cover showing a perceptible gap with the lower face of the caseband, the lower shell being secured to said caseband by means of a plurality of screws traversing said lower shell in its peripheral region.

* * * * *